United States Patent [19]

Hopper

[11] Patent Number: 4,850,743

[45] Date of Patent: Jul. 25, 1989

[54] TEMPLATE LEVELLING DEVICE

[75] Inventor: Hans P. Hopper, Aberdeen, Scotland

[73] Assignee: The British Petroleum Company p.l.c., London, England

[21] Appl. No.: 99,769

[22] Filed: Sep. 22, 1987

[30] Foreign Application Priority Data

Sep. 25, 1986 [GB] United Kingdom ..... 8623089

[51] Int. Cl.[4] ..... E02B 17/02

[52] U.S. Cl. ..... 405/190; 405/229; 405/196; 405/195; 254/102

[58] Field of Search ..... 405/229, 230, 224, 227, 405/195, 196; 254/102

[56] References Cited

U.S. PATENT DOCUMENTS 4,212,562 7/1980 Stone et al. ..... 405/229 X 4,684,291 8/1987 Hopper ..... 405/195

FOREIGN PATENT DOCUMENTS 2054710 2/1981 United Kingdom ..... 405/227

*Primary Examiner*—Dennis L. Taylor

*Attorney, Agent, or Firm*—Morgan & Finnegan

[57] ABSTRACT

An operator for levelling a drilling or production template on the sea bed is formed from a rotatable hydraulic cylinder, a piston within the cylinder to which hydraulic pressure can be applied, and a drive shaft from the piston to a screw jack. Hydraulic pressure applied to the piston counteracts the weight of the template so that the operator can rotate the screw jack with relatively little torque. The operator may fit into a housing of the template through an intermediate housing. The operator and the intermediate housing may be releasably locked to each other and the template so that they can be recovered for re-use. A cementing/retrieving tool and a suspension tool may be used in combination with the operator.

The screw jack may bear onto a mud mat or pile of the template.

12 Claims, 11 Drawing Sheets

TEMPLATE LEVELLING DEVICE

This invention relates to an apparatus and a method for levelling a drilling or production template on the sea bed or similar offshore location, particularly in deep waters.

A considerable proportion of remaining oil reserves is believed to lie offshore under depths in excess of 200 meters, in relatively small oil fields, and in hostile environments. As any one of these conditions intensifies, and more particularly when two or more are combined, the cost of conventional offshore recovery systems wherein drilling and production facilities are mounted on surface platforms rises rapidly and soon becomes uneconomic.

For this reason attention has been given to subsea systems where a favoured technique is to drill a number of locational wells close together and to mount the well head control equipment on the sea bed. In order to do this, a structure known as a template is employed. In essence this is a large frame with guide tubes for drilling which is deposited on the sea bed in a desired location. After drilling, well head completion and production equipment are mounted on the frame and these facilities remain on the sea bed.

This gives rise to further problems, however. One is the fact that the sea bed is frequently uneven and the template requires to be levelled horizontally to minimise operational problems during the drilling and production programmes. Another problem is that the template could be installed in an area of soft, silty mud and thus require jacking above the nominal sea bed datum. Also the template may well be situated at depths beyond the limits of current diving technology.

The specification of U.S. Pat. No. 4,684,291 describes and claims a screw jack for levelling a subsea template, which does not require the use of divers, the screw jack comprising (a) a guided entry adapted to receive a flat-sided drive shaft,
(b) an inner screw adapted to be rotated by the drive shaft,
(c) a non-rotatable inner housing, through one end of which the screw is threaded,
(d) a non-rotatable outer housing, against one end of which the screw bears, the outer housing being axially moveable relative to the inner,
(e) a base against which the inner housing rests, and
(f) one or more projections on the outer housing adapted to bear against corresponding projections on the template, the arrangement being such that rotation of the drive shaft causes relative axial motion between the inner and outer housings.

The specification includes a method of levelling a subsea template using a screw jack as described above.

With this screw jack the levelling force (either to lift a corner or side of the template or to lower a corner or side) is proportional to the pitch of the screw and the torque applied. With relatively small, light templates the torque available from a drilling rig or other surface vessel may be adequate for the task, but with large, heavy templates additional assistance may be required. The jack of the above mentioned specification is also shown as being connected to the template by release pins so that the jack can be recovered, but release of the pins would require the use of a ROV or other specialised equipment.

The present invention provides a hydraulic cylinder and piston for the operation of a screw jack on a subsea template so that both hydraulic pressure and torque can be applied to the template for the levelling process. It also provides template levelling equipment in which all the main components can be readily recovered for reuse.

According to the present invention an operator for rotating a screw jack on a sub-sea template comprises (a) a hydraulic cylinder capable of being rotated by a drilling rig or by a source of energy at the sea surface,
(b) a piston within the cylinder rotating with the cylinder but also capable of axial movement within the cylinder,
(c) a drive shaft extending from the piston capable of engaging with a screw jack, and
(d) means for connecting, directly or indirectly, the operator with the template to provide the reaction against which torque is applied by the operator to raise or lower the template on the jack.

In use therefore, the operator applies, through its piston and drive shaft, hydraulic pressure to balance or reduce the effective weight of the template on the screw threads of the screw jack. Rotation of the operator can then raise or lower the template with a relatively small torque force.

In a preferred embodiment the operator is attached to the end of a drill string through a piston rod connected to the drill collars or heavy weight drill pipe. This rod, which may be polished, has the piston itself at its end. Below the piston is a flat sided or fluted drive shaft which passes through a drive bushing at the end of the cyliner away from the drill string. In this way rotation of the drill string rotates not only the piston rod, piston and drive shaft but, through the bushing, the hydraulic cylinder also.

Hydraulic fluid may be fed through the interior of the drill string (suitably cleaned), then through a guard filter into the piston rod and out through a vent in the piston rod into the cylinder itself above the piston. The top of the cylinder may have one or more one-way relief valves which are opened by the piston when it is at the top of its travel, hard up against the top of the cylinder.

The bottom of the drive shaft may have a floating bushing that can transmit the downward force of the rotated shaft and cylinder to a stationary screw via a low friction load bearing face.

For purposes which will be described hereafter the drive bushing of the cylinder may have a torque pin or pins around its circumference. Also within the drive bushing may be a set of locking pistons that can be moved radially outwards by the drive shaft to lock the operator into a housing, or inwards to release it from the housing.

The housing provides the connection between the operator and the template and transmits the forces from the operator to the template. It may consist of an upper screw housing which is non-rotatable and which is releasably fixed to the template by a set of locking pistons actuated by a locking sleeve.

The locking sleeve may have a torque slot or a set of torque slots so that it can be rotated by torque pins on a suitable tool to lock or unlock the locking pistons.

There may also be one or more torque slots in the main body of the upper screw housing for use in a way described hereafter.

It may also have one or more torque pins on its outer circumference mating with torque slots on a template housing to prevent the housing rotating in the template.

Preferably more than one torque pin is employed for each duty for ease of location and to spread the load.

Below the upper screw housing is a lower screw housing. It is locked to the upper housing by a locking ring, but it is rotatable and so has a bearing or low friction load bearing faces between it and the upper housing. Torque slots within this lower screw housing mate with the torque pins on the operator so that rotation of the operator rotates the housing also. The locking pistons of the operator also match up with a lock ring within the housing so that the operator and housing are releasably connected.

The lower part of the lower screw housing is a hollow tube having at its base a keyed threaded bushing or a keyed downward release threaded slip ring. Within this bushing or slip ring is a screw extending up within the bore. The top of this screw is adapted to abut against the floating bushing of the operator. The bottom of the screw is a flat sided or splined shoe nut designed to fit into a foot on the template. It may have shear pins so that it can be released from the template at the completion of the levelling operation.

If there is any failure in the operator, the template will remain at the set level. An upward pull will controllably release the operator which can then be repaired on the surface.

The template may have a specially adapted housing to receive the operator and upper and lower screw housings. This housing may have a funnel shaped guide cone at the top, a locking ring to receive the locking pistons of the upper screw housing and torque slots to receive the torque pins of the upper screw housing. The guide cone may be fixed or releasable depending on the template requirement. A releasable cone will provide a smoother profile on the system when it is removed, thus rendering the system less likely to snag fishing trawls. The bottom of the housing may have the foot for receiving the screw shoe of the lower screw housing, this foot being part of a mud mat at the base of the template. The housing may be welded onto the main tubular frame of the template. There may be rods with shear pins connecting the main frame of the template with the mud mat.

With the above embodiment the operator and upper and lower screw housings can all be simply and easily recovered by the drill string after the levelling operation, the template being then fixed by piles.

However there are a number of variants in the levelling operation for which the operator and upper and lower screw housings may be used.

In one embodiment the operator and upper and lower screw housings may be used with the screw jack described and claimed in the afore-mentioned UK Patent Application 2174975A. In this embodiment the lower part of the lower screw housing has no screw shoe, but forms the inner screw of the screw jack. With this embodiment, while the operator itself may be recoverable, the housings and the screw jack itself can only be recovered by the use of jack release pins and a separate recovery operation.

In another embodiment, the operator and lower screw housing may be rotated and hydraulic pressure may be applied, not through a drill string, but by hydraulic lines from a surface vessel. In this embodiment, a hydraulic motor will be required in the operator. In yet another embodiment the operator and screw housing may be used directly onto a pile to correct any misalignment and make adjustments to levels. This embodiment may be used with either level or very soft sea bed locations. The piles may be installed by piling or by drilling and cementing, after which the template is levelled. The cementing operation may use a special cementing tool to lock up the system. The operator is removed and the cementing tool lowered and releasably fixed into the upper screw housing, cement being then fed through it into the pile mechanism.

This cementing tool may also double as a retrieving tool for the upper and lower screw housings in whatever mode they are being used, ie for recovery after a screw jack levelling operation as well as after a pile levelling and/or cementing operation.

As a final embodiment, the template housing, which, as previously explained, is designed to receive and hold the screw housings and operator, may also be used for the initial lowering of the template, by employing a suspension tool with locking pistons and torque pins capable of fitting into the locking ring and torque slots of the template housing. The locking pistons may be releasably actuated by a ROV.

The invention is illustrated with reference to the following drawings in which

Figure 1:
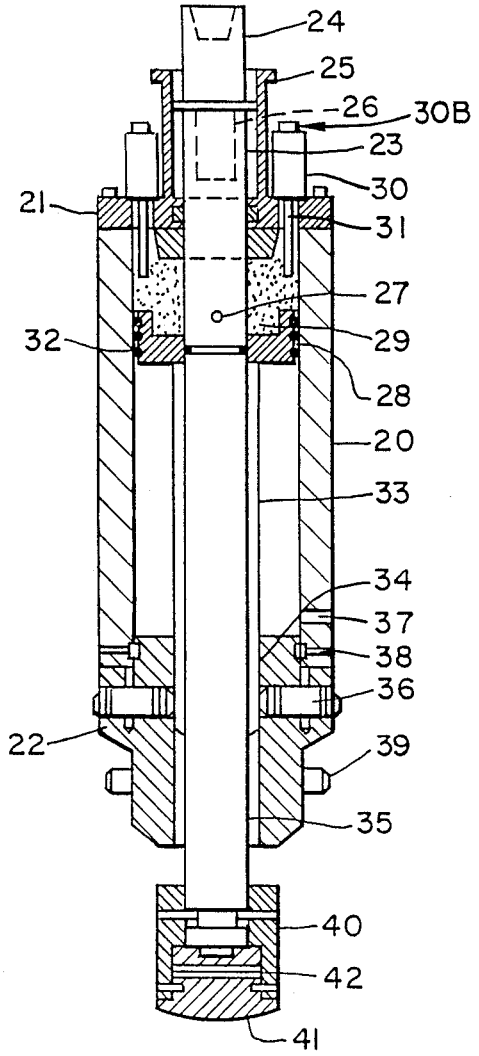
FIG. 1 is a section through an operator.
Figure 2:
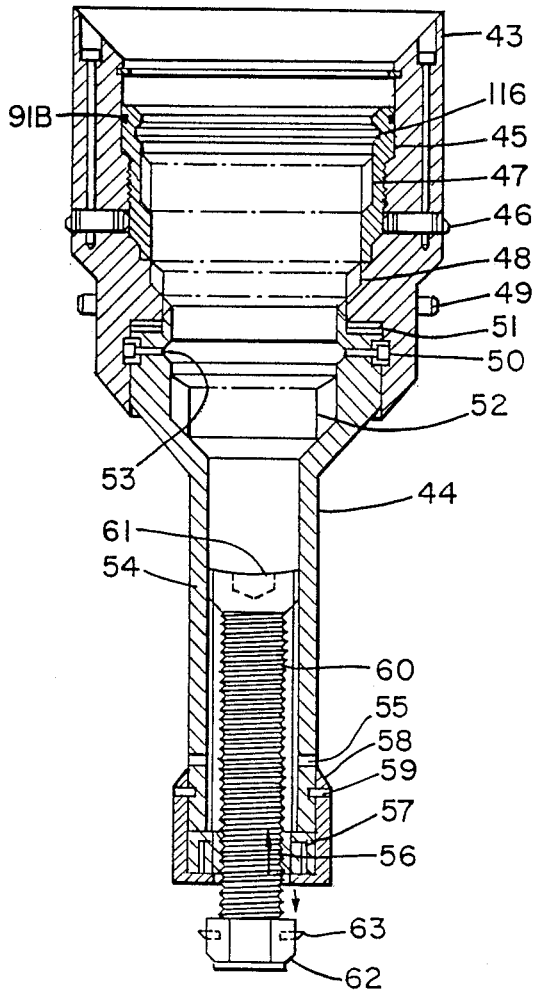
FIG. 2 is a section through a screw housing, with upper and lower portions.
Figure 3:
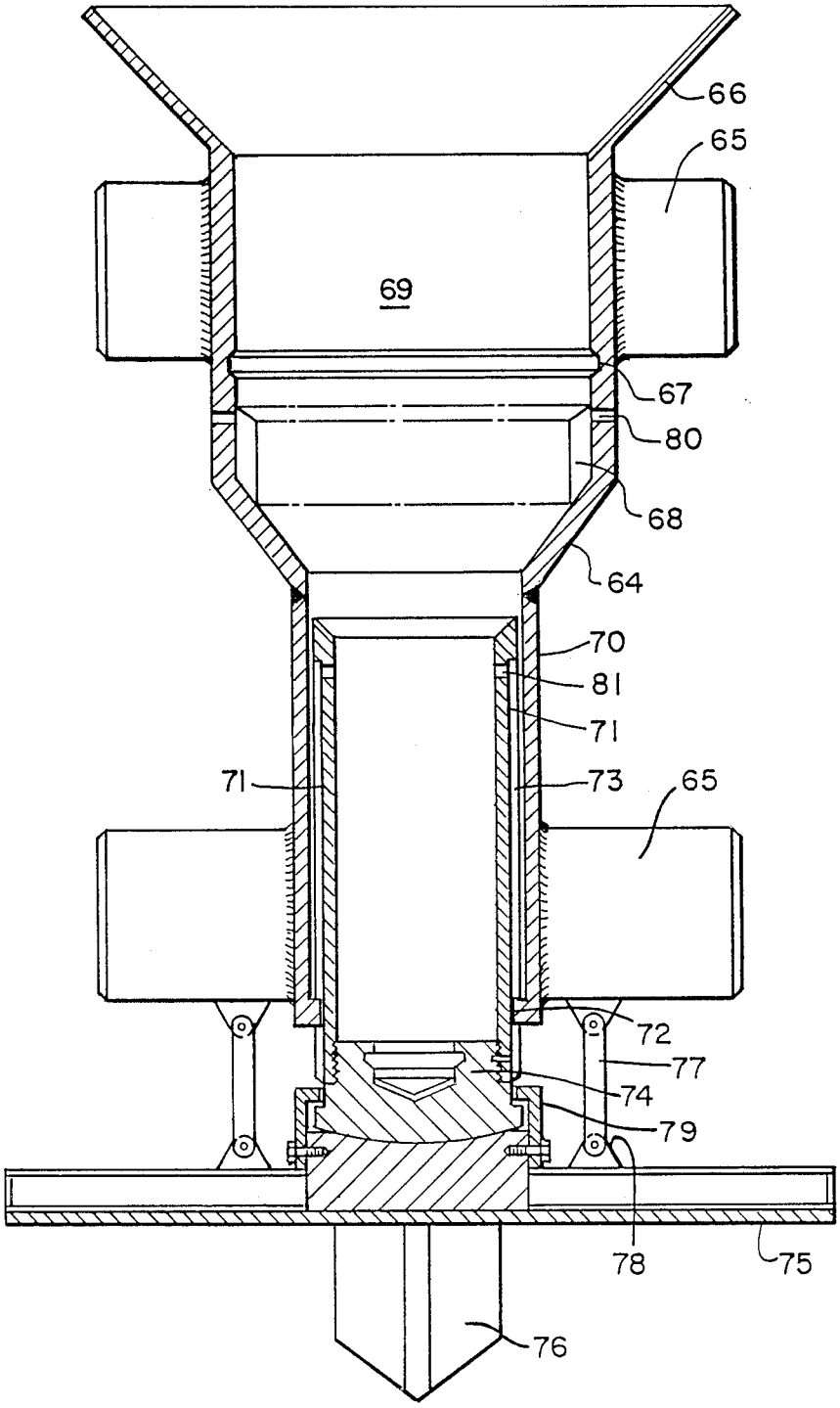
FIG. 3 is a section through a template housing with mud mat.
Figure 4:
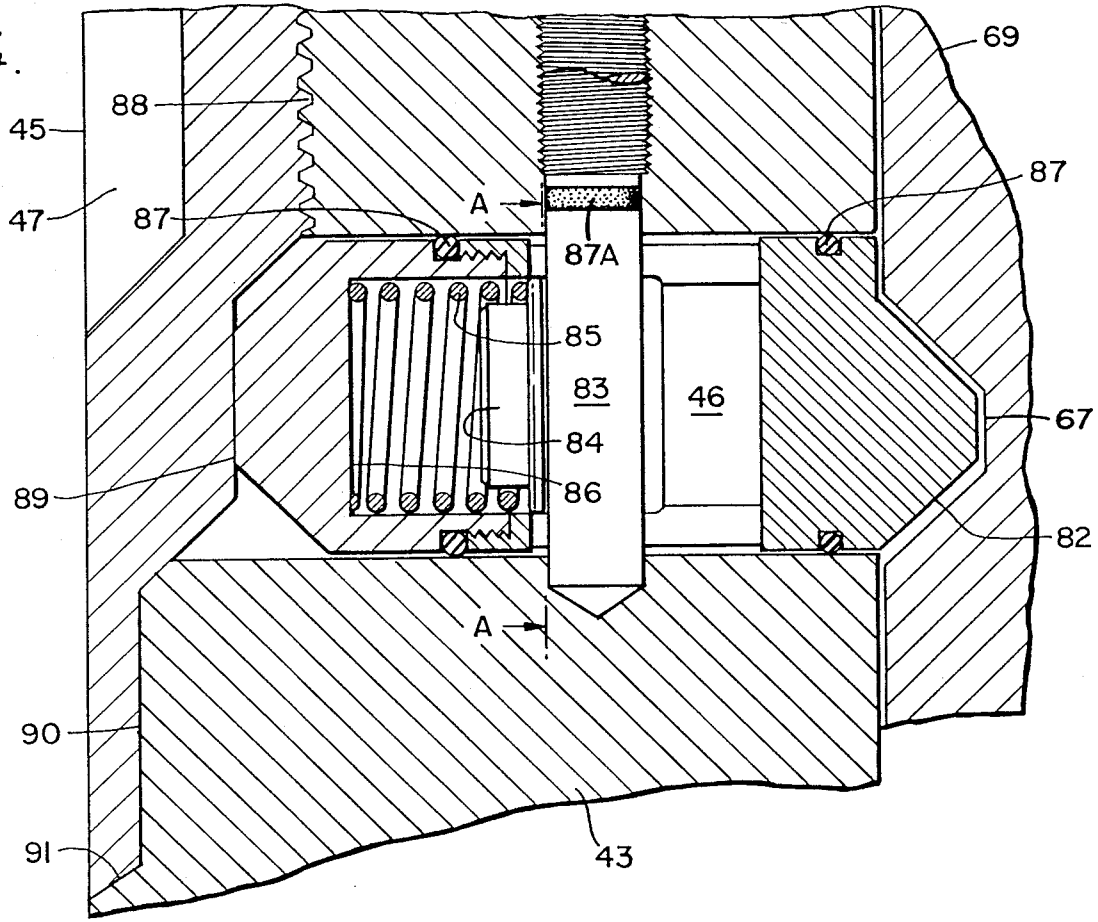
FIG. 4 is a section through a locking piston.
Figure 5A:
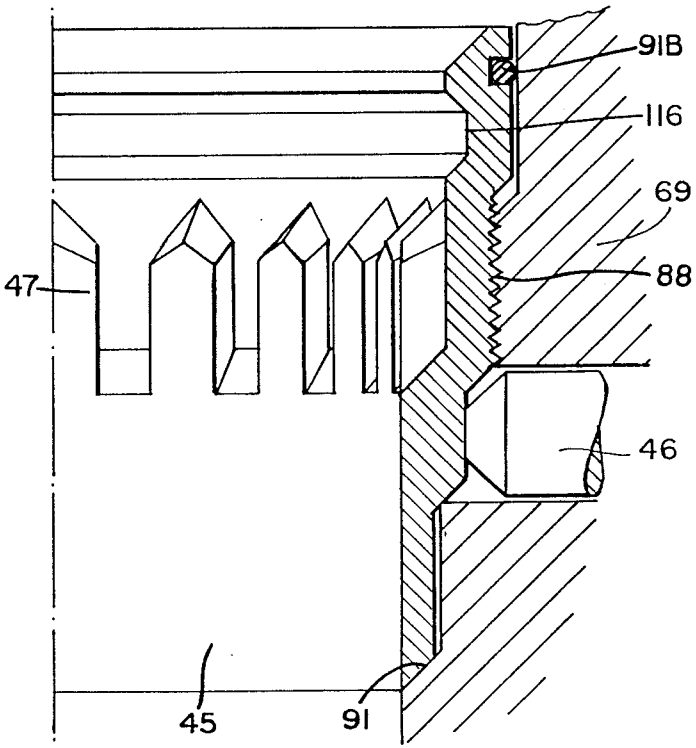
Figure 5:
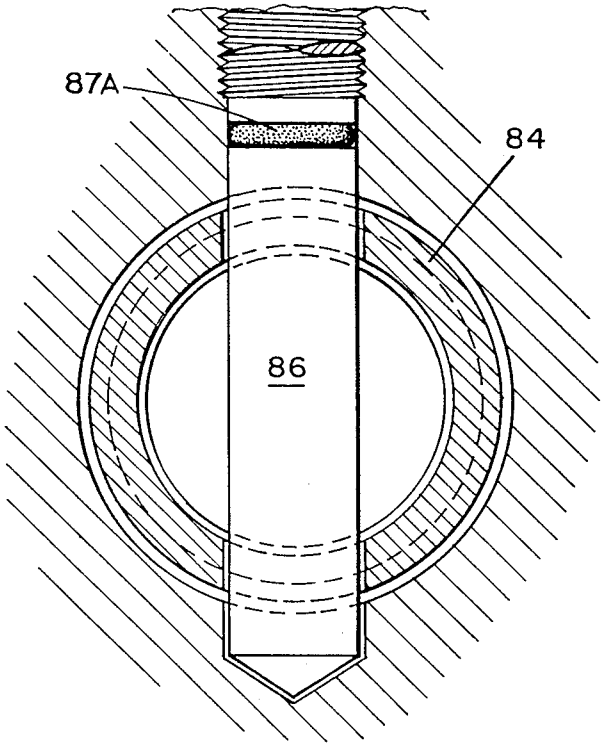
Figure 6:
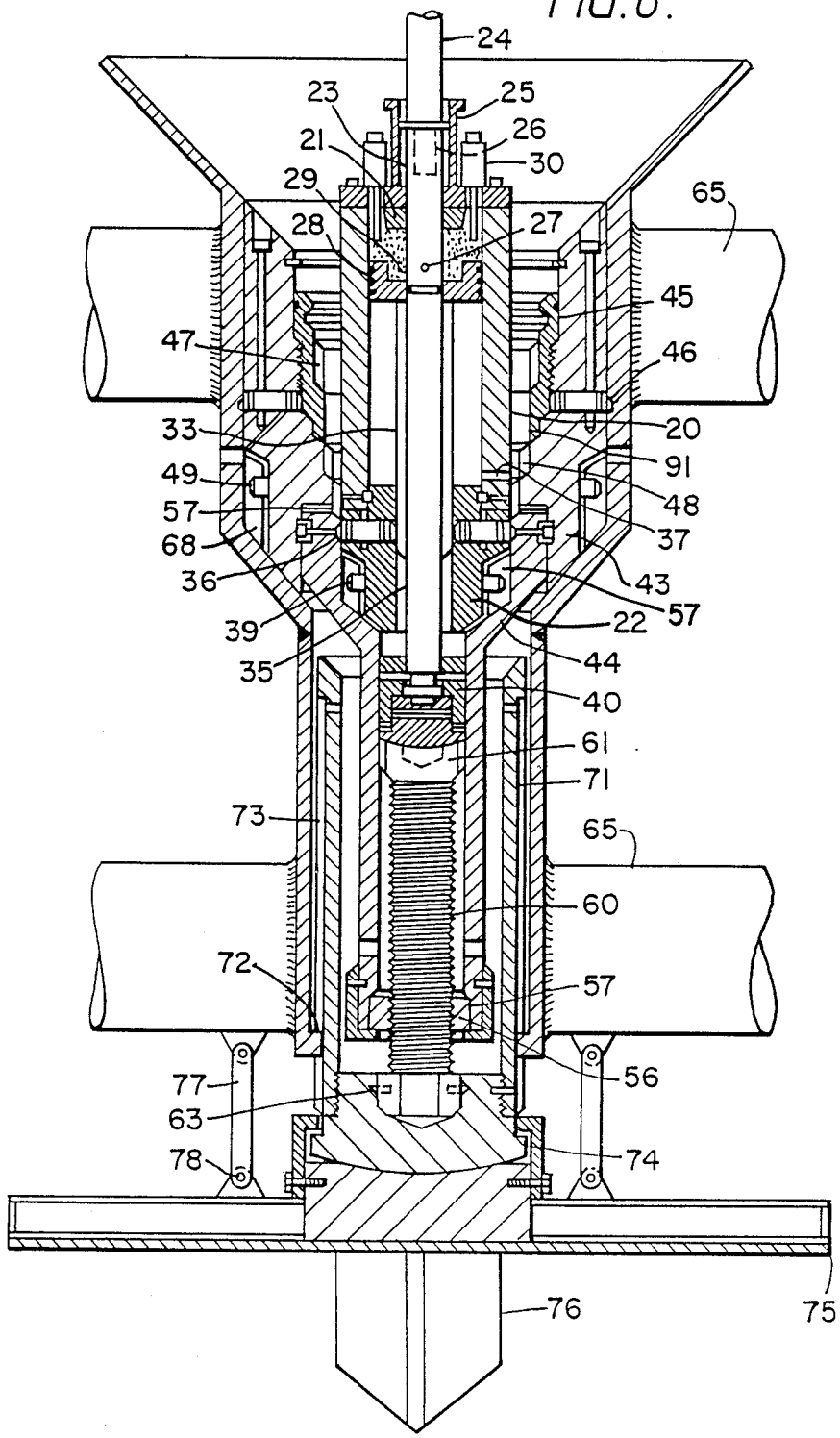
Figure 7:
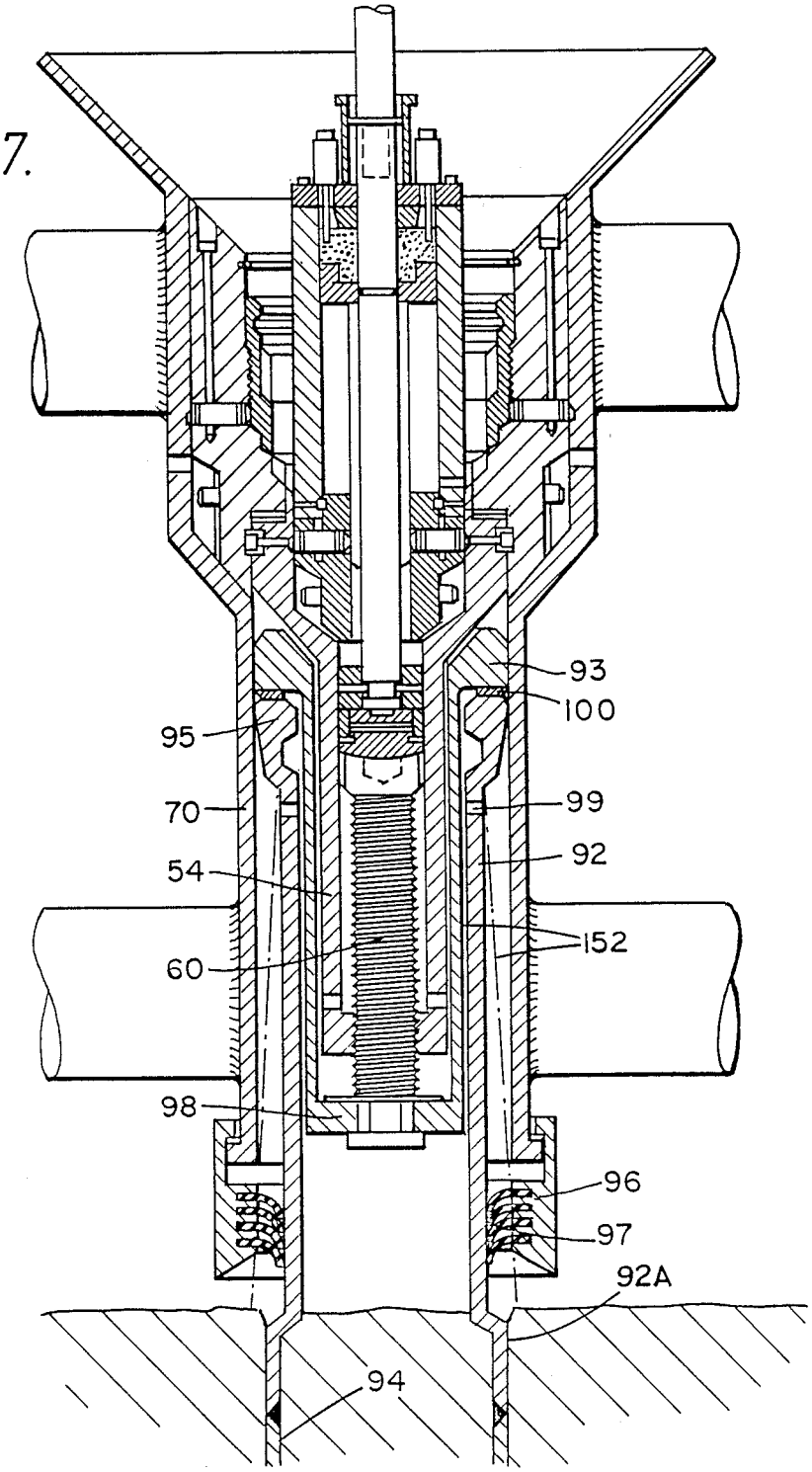
Figure 8:
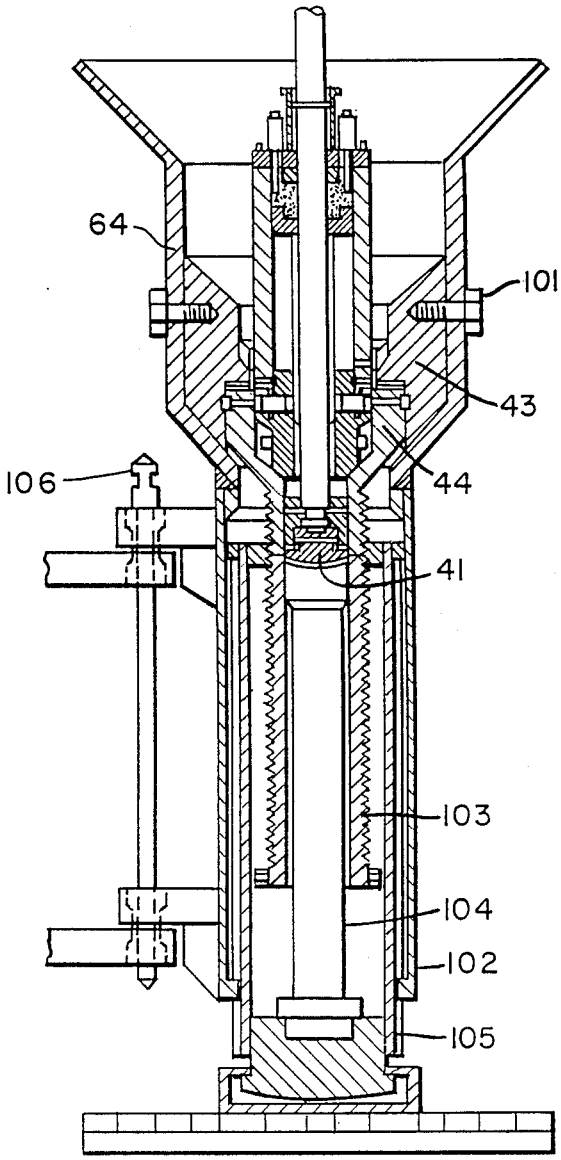
Figure 10:
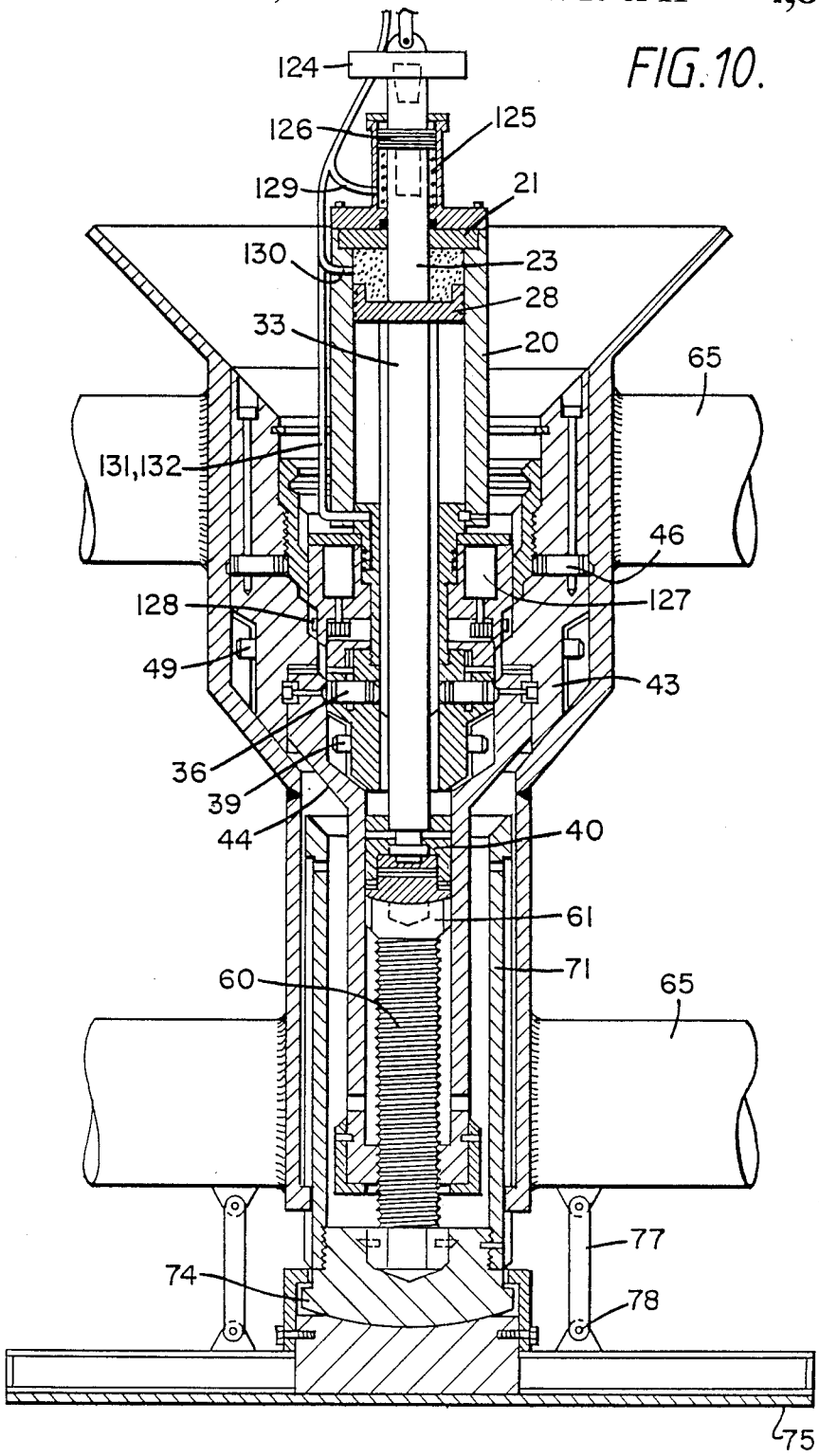
Figure 11:
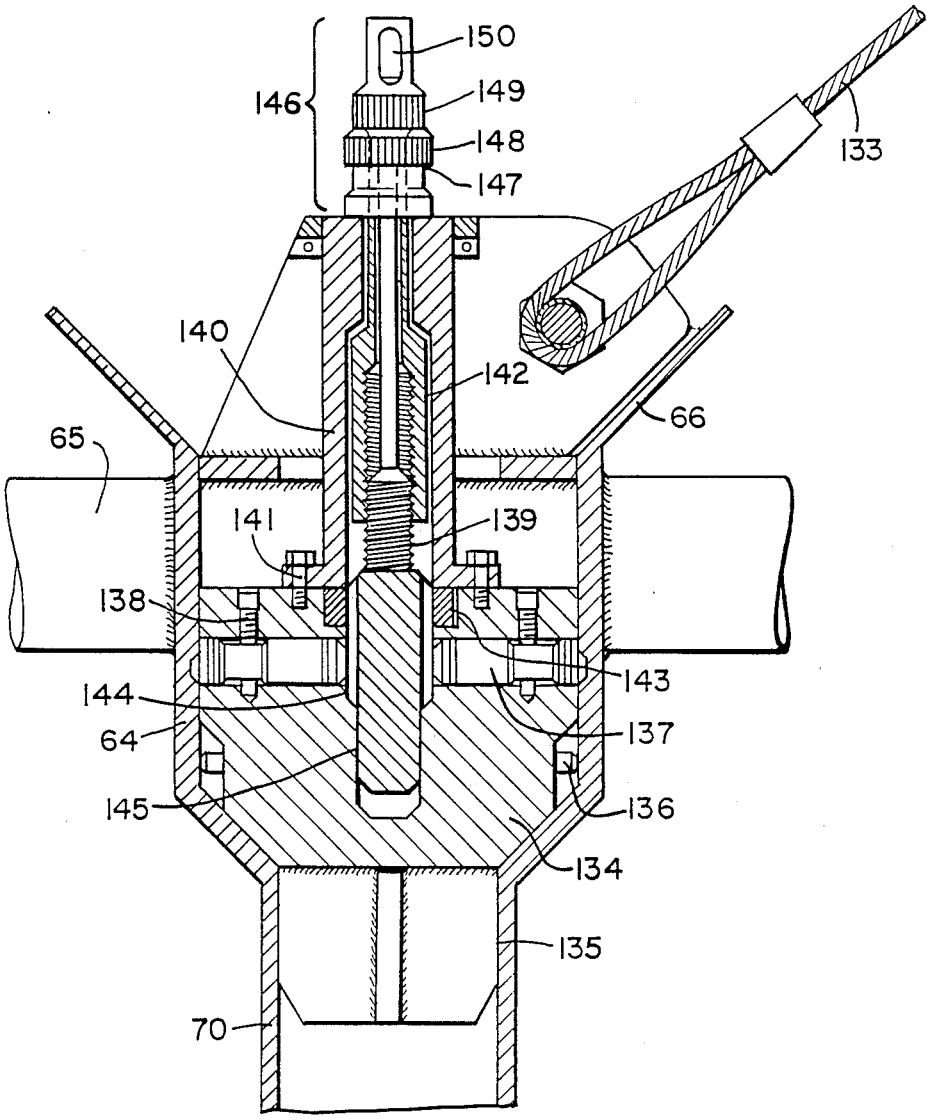

FIG. 5 is another section through a locking piston along the line A—A of FIG. 4, and FIG. 5A is a section through an upper screw housing and locking piston, FIG. 6 shows the assembled operator of FIG. 1, housings of FIG. 2 and template housing of FIG. 3 ready for levelling a template with a mud-mat, FIG. 7 shows the assembled operator of FIG. 1, housings of FIG. 2 and template housing of FIG. 3 ready for levelling a template via a pile, FIG. 8 shows the assembled operator of FIG. 1, adapted housings of FIG. 2 and adapted template housing of FIG. 3 ready for levelling with the screw jack described in U.S. Pat. No. 4,684,291, FI9. 9 is a section through a cementing/retrieving tool, FIG. 10 is a section through an assembly similar to FIG. 6 but with the operator and lower screw housing rotated by a hydraulic motor supplied by hydraulic lines, and FIG. 11 is a section through a template suspension tool.

In FIG. 1, an operator according to the present invention is made up of a cylinder 20 having an upper end plate 21 and lower drive bushing 22. Plate 21 has an opening with fluid tight seals through which passes a piston rod 23. Rod 23 is fixed to a make-up sub 24 of a hollow drill string. An annular guard 25 projecting up from plate 21 surrounds rod 23. The rod is hollow having a mesh filter 26 within it and it has a fluid inlet hole at 27. At the lower end of rod 23 is a piston 28 hollowed out on the rod side to form a sediment trap 29. Extending through end plate 21 are one-way spring-loaded relief valves 30. The relief valves 30 include check valves (marked 30B) at the top to prevent ingress of water when the valves are open. When piston 28 is at its topmost position these valves are held open by the piston pushing on the relief valve rods 31.

In use, this part of the operator starts with piston 28 at the top of its travel, holding relief valves 30 open. As hydraulic fluid is supplied via the drill string, make up sub 24, filter 26, rod 23 and fluid inlet 27 to the top side of piston 28, the fluid balances the water pressure and the weight of the system forces piston 28 down the cylinder 20, closing valves 30. Seals 32 in the piston ensure that there is no leakage of fluid between piston and cylinder. Piston 28 can travel up or down the full length of the cylinder 20 by application or withdrawal of hydraulic fluid, any air or fluids below the piston escaping via vent 37.

Attached to the underside of piston 28 is a drive shaft 33. It is preferably flat-sided. If flat-sided it may be of square cross-section but is preferably hexagonal or octagonal. Alternatively, it could be cylindrical with torque grooves. Shaft 33 passes through bushing 22 whose bore 34 is of the same flat sided configuration, or splined to match the torque grooves. Lock ring 38 holds the bushing and cylinder together. Consequently rotation of the drill string rotates not only the make up sub, piston rod, piston and drive shaft but also cylinder 20 and, therefore, the complete operator. The lower end of shaft 33 has a reduced diameter 35 acting as a release area for locking pistons 36. With the piston at the top of its travel locking pistons 36 retract into the release area 35, but as the piston and shaft move downwards the pistons are forced outwards as shown in the drawing. Bushing 22 also has a set of torque pins 39 around it.

The bottom of shaft 33 has a floating bushing 40, within which is a shoe 41, rotatable relative to the bushing 40. A low friction load face or bearing 42 lies between bushing 40 and shoe 41 so that the downward force of the rotatable shaft and operator can be transmitted to a stationary non-rotatable screw described hereafter.

FIG. 2 shows a screw housing divided into upper 43 and lower 44 housings. Within the upper screw housing is a locking sleeve 45 screw threaded into the housing and hence capable of being moved up and down to actuate locking pistons 46. (FIGS. 4, 5 and 5A show the locking sleeve and pistons and their operation in more detail). Within upper housing 43 there is a set of torque slots 48 and outside it a set of torque pins 49. As described in more detail hereafter torque pins 49 fit into torque slots in a template housing and so hold the upper screw housing to the template so that it does not rotate. There is also a set of torque slots 47 in locking sleeve 45.

Lower screw housing 44 is locked to the upper screw housing by a locking ring 50. However it can rotate relative to the upper housing so there is a low friction load face or bearing 51 between the contact faces of the housing. Torque pins 39 of the operator fit into torque slots 52 of the lower housing and locking pistons 36 of the operator fit into locking profile 53 so that rotation of the operator also rotates the lower screw housing.

The bottom end of the lower screw housing is a tube 54 with flow ports 55. It has at the bottom either a threaded bushing 56 with antirotation keys 57 or a downward release threaded slip ring. Bushing 56 is held on by screw cap 58 and lock screws 59. Screw 60 threads through bushing 56. The top of screw 60 has a concave surface 61 adapted to receive shoe 41 of the operator drive shaft. The bottom of screw 60 has a screw shoe 62 fitted with shear pins 63.

FIG. 3 shows a template housing 64 to house the operator and upper and lower screw housings. It is welded to the main tubular template structure 65. It has, from top to bottom, a guide cone 66, a main portion 69 having a locking profile 67 for receiving the locking pistons of the upper screw housing and torque slots 68 for receiving the torque pins of the upper screw housing, and a lower tubular portion 70. Within tubular portion 70 is a further tube 71 which is capable of sliding axially relative to portion 70 using slots 72 and antirotation strips 73. Tube 71 extends up from shoe foot 74 which is loosely fixed by a shoe cap 79 into a mud mat 75, which may have a spike 76 for use with soft sea beds. Mud mat 75 is connected to the main template structure 65 by tie rods 77 through shear pins 78. There are flow ports 80 in the main template housing 69, and also at 81 in the inner tube 71.

FIGS. 4, 5 and 5A show in more detail the design of the locking pistons 46 of the upper screw housing. The template housing is shown at 69 with its locking profile 67. The main upper screw housing is shown at 43. The locking piston 46 is hollow and has a machined flat on a truncated cone 82 at its actuating end. This cone profile in combination with the locking profile 67 of the template housing is designed so that the piston cone moves easily into the profile. A stop pin 83 passing through slots in the piston is threaded into the upper screw housing 43. Stop pin 83 acts to prevent any rotation of piston 46 and also to hold spring plate 84. Spring 85 extends between this plate 84 and the piston cap 86 acting to try and move the piston out of the locking profile 67. In operation, the piston cavity is filled with oil. Piston 46 has O-rings 87 at either end, and stop pin 83 has O-ring 87A to prevent leakage of the oil from the piston cavity.

FIGS. 4 and 5A show the piston 46 locked into profile 67 by the locking sleeve 45. To release piston 46 the locking sleeve 45 is rotated by torque pins of a suitable tool (eg those of a retrieving tool (FIG. 9)) fitting into the torque slots 47 of locking sleeve 45. Sleeve 45 is screw threaded into the upper screw housing 43 (the thread being shown at 88) so that rotation moves it upwardly with respect to the housing. Face 89 of the sleeve holding the piston therefore eventually moves above the piston and face 90 comes opposite it allowing the piston to move to the left in the drawing out of the locking profile 67. The whole upper screw housing can thus be removed from the template housing.

It will be appreciated that the locking piston can be actuated and moved into the locking profile 67 by rotating the locking sleeve in the reverse direction.

The end of locking sleeve 45 is chamfered and abuts a shoulder on the upper screw housing when the locking sleeve is down and holding the locking piston into its profile. There is a metal seal 91 between the locking sleeve and the upper screw housing at this point to seal the piston and its chamber from ingress of any sea water, other fluids or debris from below. There is also an elastomeric seal 91B at the top of locking sleeve 45 sealing the sleeve against the upper screw housing 43 and preventing ingress of sea water etc to screw thread 88 and the locking piston 45 from above.

It will also be appreciated that the locking pistons 36 of the operator are of a similar design and function locking the operator into the lower screw housing. As explained in FIG. 1, however, the locking pistons 36 of the operator are not actuated by a rotatable locking sleeve but by downward movement of the drive shaft.

FIG. 6 shows all the components of FIGS. 1 to 5A assembled ready to level a template. The parts have the same numerals as FIGS. 1 to 5A.

Figure 9:
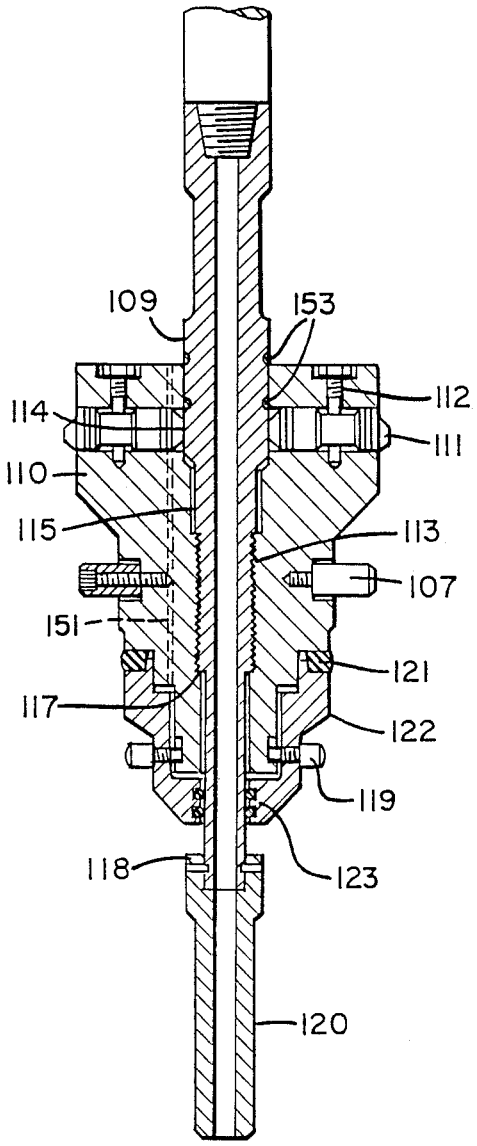

To assemble the parts, a template with a number of housings 69 and mud mats may be lowered to the sea bed using the suspension tool described hereafter (FIG. 11). The upper and lower screw housings 43, 44 may be in place when the template is lowered, this being preferred. However, they may be subsequently run into a template housing 69 using a drill string having at its end the retrieving tool also described hereafter (FIG. 9). Torque pins 49 of the upper screw housing slot into torque slots 68 of the template housing and the locking piston 46 is locked into locking profile 67 by rotating the locking sleeve 45 with torque pins on the retrieving tool slotting into torque slots 47 of the locking sleeve. The retrieving tool is pulled up and then the operator is run, again from the drill string. Torque pins 39 of the operator slot into torque slots 52 of the lower screw housing. Hydraulic fluid is then applied to piston 28 neutralising the hydrosphere pressure and down weight allows the piston 28 to move down until the locking pistons release area of the drive shaft passes the locking pistons 36 and the locking pistons are moved to lock into profile 53 of the lower screw housing. Hydraulic pressure is continued, moving piston and drive shaft down until shoe 41 at the foot of the drive shaft abuts surface 61 of screw 60.

The operator is run with piston 28 at the top of its travel holding relief valve 30 open. This means that the water pressure effectively locks the system open because of the check valve 30B, so that the operator can be stabbed into the lower screw housing without the risk of premature locking or jamming. It is not until hydraulic pressure is applied to piston 28 that the locking pistons 36 can move into and lock with the lower screw housing.

Further downward movement of the piston and drive shaft is now prevented but the hydraulic pressure can be increased if necessary and maintained by the use of a surface regulator until there is little or no pressure on the screw-thread between bushing 56 and screw 60. Rotation of the drill string and hence also the operator and lower screw housing can therefore raise or lower the template housing relative to screw 60, inner sleeve 71 and mud mat 75. Tie rods 77 hold the mud mat to the template during lowering, and on raising the template shear pins 78 will be sheared. The hydraulic pressure is adjusted by the use of the regulator as the template is raised or lowered to move the piston and drive shaft axially and keep shoe 41 in contact with surface 61 of screw 60.

When the particular side or corner of the template has been adjusted to its required level, rotation is stopped and the hydraulic pressure released. Piston 28 is pulled up to its top position opening relief valves 30, releasing the hydraulic pressure, and bringing the locking pistons 36 into the release area 35 of shaft 33. The operator can now be withdrawn by pulling up the drill string. The upper and lower screw housings can also be withdrawn after the template has been piled by running the retrieving tool and unlocking the upper screw housing from the template.

The operation can then be repeated through a template housing at a different side or corner of the same template until the whole template is levelled. The template can then be piled into place, and the levelling equipment made available for use on other templates.

The sequence of levelling operations preferably follows that described in U.S. Pat. No. 4,684,291. Three template housings and jacks may be used in a triangular configuration, but preferably there are four housings and jacks in diagonally opposite pairs. The jack diagonally opposite the highest jack is raised until the diagonal line between the two jacks is horizontal. This will mean that the two jacks are carrying the majority of the weight of the template. The other pair of jacks is then raised until they are slightly higher than the first pair, transferring the weight from the first pair to the second pair. Either the first may now be raised to the height of the second pair or the second pair may be lowered.

With a mud mat beneath each jacking point, the above sequence ensures that each mat has been subjected to twice the load it will have when the levelling operation is complete.

FIG. 7 shows the operator and upper and lower screw housings being used for pile levelling. In this embodiment the operator and upper and lower screw housings are essentially the same as those for use with a screw jack and they are lowered and fixed into a template housing having a guide cone and upper housing, again exactly as for screw jack levelling.

However, in this method of use the template will have been built with template housings above, not a mud mat, but in position for a pile or pile housing. Such a template would be used either on a very soft sea bed or a hard, near-horizontal sea bed. It could also be used on a non-horizontal hard sea-bed, if the exact inclination were known, since the template could be designed for this inclination with the housings being placed at different elevations.

The template is lowered and then a pile is run through the housing with a suitable pile top section. This pile top consists of a sleeve 92 of narrower diameter than the lower portion 70 of the template housing but of larger diameter than the lower portion 54 of lower screw housing. It, therefore, is capable of fitting within the annular void between the template housing and the lower screw housing, the width of this void 152 allowing sleeve 92 a certain degree of mis-alignment from the vertical for levelling purposes.

Sleeve 92 has a slightly widened portion 92A at its bottom which may be connected to a pile 94 of the same diameter. This is piled or run into a drilled hole in the sea bed on a centralising running tool. In the latter case the pile is cemented into the hole. The top of the sleeve has a pile running profile 95 capable of taking a downward force. It also has vent holes 99.

The previously run template housing has a gland 96 at its foot with flexible seals 97. The sleeve 92 is run through this gland and the seals, the seals acting as a seal for a subsequent cementing operation.

Sleeve 92 must be piled or run and landed so that the top of the sleeve is at the correct vertical position shown within the template housing. This is achieved by the use of a stop shoulder on the centralising running tool.

The upper and lower screw housings and then the operator are run and located as for screw levelling. The lower screw housing is, however, of slightly modified design. A piggy back sleeve 98 is mounted around the lower portion 54 of the lower screw housing, it being threaded onto screw 60 in place of the screw shoe used for screw jack levelling. The top of sleeve 98 has an up-set flange 93 and a soft, plastically deformable load ring 100. The flange and ring are designed to align with flange 95 of pile sleeve 92.

The operator and lower screw housing are rotated as in the previous embodiments. Hydraulic pressure applied to the piston of the operator will transmit a downward force through piggy back sleeve 92 and lift the template on the pile.

The same sequence of operations can be used to run and level the template on piles on other sides or corners of the template.

When the template is level, the piles can then be cemented using the cementing tool (FIG. 9) or otherwise fixed into place.

FIG. 8 shows the operator of FIG. 1 used to apply hydraulic pressure to the screw jack of U.S. Pat. No. 4,684,291. The operator is the same as that previously described. However the template housing 64 is fixed to the outer housing 102 of the screw jack. Also the parts equivalent to the upper and lower screw housings 43, 44 are made integral with the template and are fixed and installed on the template prior to its being lowered to the sea bed. The upper screw housing 43 is fixed to the template housing 64 by screws 101. The lower screw housing 44 is fixed to the inner screw 103 of the screw jack.

The screw jack itself is modified as compared with that of U.S. Pat. No. 4,684,291 only in that a mandrel 104 extends up inside screw 103, this mandrel being fixed to the inner housing 105.

When the operator is run and landed, its shoe 41 bears on this mandrel 104 and so can transmit hydraulic pressure to counteract the weight of the template. Then the operator and inner screw housing can be rotated using a relatively small torque force to raise or lower screw 103 relative to inner housing 105 and hence raise or lower outer housing 102 and the template itself.

At the conclusion of the levelling operation, the operator may be released and withdrawn as previously described, but the template housing, upper and lower screw housings and the screw jack itself can only be recovered as a whole by using the jack release pins 106.

FIG. 9 shows a tool for running and retrieving the upper and lower screw housings of FIG. 2 and also for the cementing of piles.

The tool is designed to fit into the torque slots 47 of the locking sleeve 45 of the upper screw housing 43 (FIG. 2). Removable torque pins 107 on the tool are used for this.

The tool comprises a mandrel 109 passing through a main body 110. Within the main body are locking pistons 111 with stop pins 112. These pistons are of the same design as those of the operator or upper screw housing. They are locked or unlocked by rotation of the mandrel within the main body using threads 113, rotation either bringing locking faces 114 or unlocking faces 115 into alignment with the pistons.

Locking pistons 111 engage with a profile (116, see FIGS. 2 to 5A) on the locking sleeve 45. The tool is run until torque pins 107 engage the torque slots 47 of the locking sleeve 45. Rotation of the tool mandrel 109 will then lock pistons 111 into the locking profile 116 of the locking sleeve. The tool body does not rotate during this operation, torque pins 107 holding it in the torque slots 47 of the locking sleeve. The mandrel 109 has, however, only a limited axial travel with respect to the body 110, sufficient to bring either face 114 or face 115 into alignment with locking pistons 111. Further axial movement is prevented either by shoulders 117 or stop 118.

Further rotation will, therefore, rotate the main tool body with the mandrel, thereby rotating the locking sleeve 45 and unlocking its pistons. The upper and lower screw housings can then be withdrawn with the tool.

During the locking of the tool into the locking sleeve and during the unlocking of the sleeve, a downward force should be maintained on the tool. This force can be applied if the tool is run on a drill string, the heavy-weight drill pipe or drill collars and rig compensator being used in the same way as if applying a downward force to a drill bit.

Although the tool of FIG. 9 has been described with reference to retrieving the upper and lower screw housings, it will be appreciated that the reverse operation of the tool can, and is, used to run and land the upper and lower screw housings in the first instance if desired.

If used for cementing a pile or for locking up a screw-jack, torque pins 107 are not required and are removed. Threaded plugs acting as thread protectors are inserted instead. Torque pins 119 are fitted, after removal of the plugs which are there for running or retrieving. Torque pins 119 are designed to fit into torque slots 48 on the main upper screw housing, rather than into the torque slots of the locking sleeve.

The protective cap (not shown) which fits onto the end of the mandrel 109 providing a stop 118 when running or retrieving is removed and a tubular cement stinger 120 is attached. The foot of the main body 110 in which torque pins 119 are fitted has a separate energising sleeve 122 held to the main body 110 by the torque pins 119 fitting into slots in the energising sleeve 122. Sleeve 122 is separated from the main body 110 by a weight energised seal 121. There are also seals 123 around the mandrel where it passes through the energising sleeve 122. Torque pins 119 hold the energising sleeve 122 and main body 110 together preventing both from rotating. The slots in the main body 110 into which the torque pins fit, however, allow limited axial movement as between sleeve 122 and main body 110. Mandrel 109 is hollow so that there is a bore extending right through it and through the cement stinger.

To use the tool for cementing, it is run on drill string and landed in an upper screw housing which is above a pile, torque pins 119 slotting into torque slots 48. Downward force energises seal 121 thereby sealing the top of the pile. Fluid trapped between main body 110 and sleeve 122 is vented through port 151. Mandrel 109 is rotated to lock pistons 111 into the locking profile 116 of the locking sleeve. The locking sleeve 45 itself cannot be rotated, however, since, for cementing, the tool has torque pins 119 which are in slots 48.

Cementing can now commence using established procedures. Circulation using sea water is established through the bore of the mandrel and stinger and the flow rate in respect to the back pressure is recorded. Cement can now be spotted, the cement pressure acting on the bottom of the sleeve 122 to increase the sealing force on seal 121. When a clear cement flow is observed venting from the pile housing ports, the tool is unlocked by rotating the mandrel, thereby withdrawing the locking pistons. The unlocked tool is pulled up out of the upper screw housing as far as possible while maintaining the cement stinger within the pile guide cone. The remaining cement is dumped on top of the pile, partially filling up the guide code. The tool is finally pulled up clear of the template and recovered. It could then be run and landed in the next template housing and pile. When all cementing operations are complete it is recovered and thoroughly washed.

The top of the mandrel may have indicator marks or grooves 153 to show the exact axial position of the mandrel within the body and to indicate the required extent of travel for locking and unlocking operations and for any other operations during running, retrieving or cementing. An underwater TV camera may be used to observe these marks or grooves and monitor the operation of the tool.

A template is normally lowered prior to well drilling and there will, therefore, normally be a drilling rig on location for use in levelling. If there are any circumstances when a drilling rig is not available, the modified embodiment shown in FIG. 10 may be used. FIG. 10 shows an assembled jack, template housing, upper and lower screw housings and operator essentially the same as in FIG. 6 with the same numerals used. The difference lies in the operator. The operator is not suspended from a drill string and make up sub but can be preinstalled or can be run from a cable using a swivel coupling 124. There is no entry for hydraulic fluid via the drill string and piston rod so there is no fluid inlet in the piston rod.

The guard above cylinder top 21 and around piston rod 23 is converted into a hydraulic cylinder 125. The piston rod has a further sealed piston 126 with seals within this cylinder. Hydraulic fluid entering the cylinder below this piston can apply an upward force on the operator, giving an upward pull action equivalent to that previously applied by the drill string. Piston 28 in cylinder 20 acts in the same way to provide downward pressure as previously, but the use of opposite acting pistons 126 and 28 eliminates the needs for the relief valves in cylinder top 21. Rotation of the operator and lower screw housing is effected by hydraulic motor 127 placed around the drive shaft 33 of the operator. To provide the reaction for this motor, its casing has anti torque pins 128 which engage with the torque slots 48 of the upper screw housing (these being the same torque slots which are used for the cementing tool).

Any suitable type of hydraulic motor may be used. The hydraulic motor rotates the lower part of the operator, torque pins 39 transmitting this rotation to the lower screw housing.

There are four hydraulic lines, 129, 130, 131 and 132 leading, respectively, to the upper cylinder 125 and the main cylinder 20 and to and from the hydraulic motor 127. These lines have to pass through swivel 124 to allow for the rotation of the operator about the cable. In the event of a hydraulic failure, the whole system may be released by venting the hydraulic lines and pulling up.

It will be appreciated that the system of FIG. 10 could also be used for pile levelling as shown in FIG. 7.

The suspension tool for initially lowering the template is shown in FIG. 11. It can fit into any template housing (whether above a jack (FIG. 3) or pile, or into a separate lowering housing and there will be one tool for each housing on the template (four in most cases).

Each tool is suspended by a sling 133 from a drill pipe or riser lifting collar. The tool is formed of a main body 134 adapted to fit snugly into the upper part of the template housing 64, with guidance webs 135 which extend down into the lower part 70 of the template housing. This main body 134 has torque pins 136 slotting into torque slots 68 of the template housing and locking pistons 137 which lock into the locking profile 67 of the template housing. These locking pistons 137 have stop pins 138 and are designed and operate exactly as the locking pistons of the operator or upper screw housing.

Locking pistons 137 are locked and unlocked by a rotating sleeve 142 which raises or lowers a mandrel 139. A housing 140 is fixed by screws 141 onto the top of the main body 134 of the tool. This housing holds the screw threaded sleeve 142 into which is threaded the mandrel 139. The bottom of the mandrel is flat sided passing through a flat sided bushing 143 with anti-rotation keys, on the top of the main body. As with the flat sided drive shaft of the operator, the mandrel has piston locking surfaces 144 and piston locking release areas 145. The locking surfaces or release areas are, however, brought into alignment with the locking pistons by rotation of the mandrel rather than by straight axial movement as in the operator.

For lowering, the suspension tools may be placed in the template housings and locked in by pistons 137, prior to lifting off the barge. Confirmation of locking can be obtained from a visual indicator 150. The template is then lowered using the sling 133.

Once the template is lowered and in position on the sea bed, the tools may be unlocked from their housings by an ROV using the ROV spigot 146 at the top of the tool. This spigot may have, in known manner, a lifting profile 147, leverage spline 148, torque spline 149 and indicator 150. Operation of the spigots by a ROV to rotate the mandrels will unlock the pistons, freeing the tools from the templates and allowing them to be lifted by the slings and reused.

This suspension tool may be used to lower any template having template pile housings with locking profiles adapted to receive the locking pistons of the tool. This applies whether the template housings are above a screw jack, a pile or, indeed, even if the template housings are not associated with any of the levelling systems described previously in this specification.

FIG. 11 shows the suspension tool fitting directly into a template pile housing. However, as previously indicated, a template could be run and landed with upper and lower screw housings pre-installed within the template mud mat levelling housing. The same suspension tool can still be used in the mud mat levelling housing if the screw housings are omitted.

It will be seen that the system of the present invention provides a very versatile and flexible diverless system for all the operations involved in installing a template on a sea bed. It can cope with templates of large sizes and weights. The initial lowering of the templates can be effected by the suspension tool, the levelling can be effected either through screw jacks or directly through the piles, and the piles can be permanently locked by cementing with the cementing tool. Moreover all the main components of the system can be readily recovered for re-use.

I claim:

1. An operating tool for rotating a screw jack on a subsea template comprising:

(a) an external cylindrical framework closed at each end to form a closed cylinder which can be supplied with hydraulic fluid at its top, (b) a piston within the cylinder slidable axially within said cylinder and sealed within the cylinder so that hydraulic fluid supplied to the cylinder above the piston can exert hydraulic pressure on the piston, (c) a downward extension of said piston extending beyond the end of the cylinder through the bottom end closure, said extension forming a drive shaft for said screw jack and having its lower end, means for engaging with the top of said screw jack, (d) an upward extension of said piston having a connector for attaching said operating tool to deployment means controlled from the sea surface, (e) means for rotating the piston and its upward and downward extensions, (f) splines on the downward extension engaging with slots on the bottom end closure of the cylindrical framework so that rotation of the piston rotates also the operating tool itself, and (g) connectors on the bottom end closure of the cylindrical framework for connecting said operating tool to the screw jack on the subsea template, so that hydraulic pressure can be applied to the top of the piston to counterbalance the weight of the template and so that torque can be applied to the piston to rotate the piston and operating tool and hence the screw jack.

2. An operating tool as claimed in claim 1 wherein the upward extension of said piston has a connector for attaching it to a drill string deployed from a surface vessel, rotation of said piston and operating tool being effected by rotation of said drill string.

3. An operating tool as claimed in claim 1 wherein the upward extension of said piston has a connector to a swivel coupling deployed from a line from a surface vessel or from a remotely operated vehicle, and the means for rotating said piston and operating tool is internal means within the operating tool.

4. An operating tool as claimed in claim 3 wherein said internal means for rotating said piston and operating tool is a hydraulic motor.

5. An operating tool assembly for rotating a screw jack or a subsea template comprising an operating tool as claimed in claim 1 and a housing on the template formed of an upper non-rotatable screw housing and a lower rotatable screw housing, said connectors of the operating tool releasably connecting said tool to said housing.

6. An operating tool assembly as claimed in claim 5 wherein the connectors between the operating tool and the housing are locking pistons on the operating tool releasably locking into a groove in the housing.

7. An operating tool assembly as claimed in claim 5 wherein the upper screw housing has a locking sleeve actuating locking pistons to lock, releasably, the housing to the template.

8. An operating tool assembly as claimed in claim 5 wherein the template has a housing which receives the housing for connecting the operating tool to the template.

9. An operating tool assembly as claimed in claim 1 wherein the screw jack bears onto a mud mat of the template.

10. An operating tool assembly as claimed in claim 1 wherein the screw jack bears onto a pile of the template.

11. An operator as claimed in claim 5 having, in addition, a separate retrieving and cementing tool with locks which lock, releasably, into the upper screw housing.

12. An operating tool assembly as claimed in claim 5 having, in addition, a separate suspension tool with locks which lock, releasably, into the upper screw housing or into a housing forming an integral part of the template.

* * * * *